US012546546B2

(12) United States Patent
Zoli

(10) Patent No.: US 12,546,546 B2
(45) Date of Patent: Feb. 10, 2026

(54) BREAK-BARREL FIREARM WITH IMPROVED MANAGEABILITY

(71) Applicant: ZOLI ANTONIO S.r.l., Gardone val Trompia (IT)

(72) Inventor: Paolo Zoli, Gardone val Trompia (IT)

(73) Assignee: ZOLI ANTONIO S.R.L., Gardone val Trompia (IT)

( * ) Notice: Subject to any disclaimer, the term of this patent is extended or adjusted under 35 U.S.C. 154(b) by 0 days.

(21) Appl. No.: 18/962,560

(22) Filed: Nov. 27, 2024

(65) Prior Publication Data

US 2025/0180311 A1 Jun. 5, 2025

(30) Foreign Application Priority Data

Dec. 1, 2023 (EP) ..... 23425063

(51) Int. Cl.
*F41A 3/58* (2006.01)
*F41A 17/50* (2006.01)
*F41C 7/11* (2006.01)

(52) U.S. Cl.
CPC ..... *F41A 3/58* (2013.01); *F41A 17/50* (2013.01); *F41C 7/11* (2013.01)

(58) Field of Classification Search
CPC .... F41A 3/58; F41A 3/60; F41A 17/42; F41A 17/48; F41A 17/50; F41A 17/52; F41A 17/58; F41A 17/60; F41A 17/62; F41A 17/66; F41A 17/68; F41A 17/70; F41A 17/76; F41A 17/78; F41A 17/80; F41A 17/82; F41C 7/11
USPC ..... 42/2, 8, 9, 40, 41, 42.01, 42.02, 42.03, 42/43–48, 70.04, 70.05, 75.02, 75.04
See application file for complete search history.

(56) References Cited

U.S. PATENT DOCUMENTS 495,298 A * 4/1893 Bye et al. ..... F41A 3/58 42/41
4,926,574 A * 5/1990 Rieger ..... F41A 19/34 42/70.08
5,311,692 A * 5/1994 Blaser ..... F41A 19/15 42/69.01

(Continued)

FOREIGN PATENT DOCUMENTS

FR 2803909 A1 * 7/2001 ..... F41A 19/18
RU 2401965 C2 * 10/2010 ..... F41C 7/11
WO WO-2013128248 A1 * 9/2013 ..... F41A 3/58

OTHER PUBLICATIONS

Extended European Search Report, European Patent Application No. 23425063.7 dated May 7, 2024, 7 pages.

*Primary Examiner* — John Cooper
(74) *Attorney, Agent, or Firm* — Leber IP Law; Celia H. Leber

(57) ABSTRACT

The present invention concerns a firearm comprising at least one frame and a barrel group comprising at least one barrel, the barrel group being mounted in a sliding manner with respect to the frame, wherein the frame houses at least one trigger device configured to trigger the firing of an ammunition, a safety device configured to act on the trigger device so as to selectively disengage it, and a closing device configured to act between the frame and the barrel group so as to prevent the barrel group from tilting with respect to the frame, and is characterized in that it comprises an actuation element configured to selectively activate the safety device and the closing device.

18 Claims, 6 Drawing Sheets

(56) References Cited

U.S. PATENT DOCUMENTS 5,459,956 A 10/1995 Rowlands et al.

* cited by examiner

BREAK-BARREL FIREARM WITH IMPROVED MANAGEABILITY

RELATED APPLICATION

This application claims priority from European Patent Application No. 23425063.7, filed Dec. 1, 2023, the entire disclosure of which is incorporated herein by reference.

TECHNICAL FIELD

The present invention concerns in general a firearm, in particular a long firearm, such as a rifle, of the break-barrel type which is particularly handy in securing and opening operations.

BACKGROUND

"Rifle" type firearms have been around for decades in many different forms and types. Various types of rifle have been developed for many types of shooting. For example, and without limitations, there are single-shot shotguns, double-barrelled shotguns (double shotgun), over/under shotguns, bolt-action shotguns, semi-automatic shotguns, and so on. Technology continues to evolve to meet the diverse needs of the shooting enthusiasts.

Externally to the barrel and multi-barrel rifles there are usually provided two mechanical control elements, of which a first element for securing the cocked rifle, and a second element for opening the rifle. In essence, to proceed with the opening of the rifle it is necessary to first operate the safety of the firearm by actuating a safety control element, and then proceed to the actual opening, by actuating an opening control element.

Many factors are taken into account in the design of single- or double-barrelled rifles, including appearance, weight, sensitivity, ease of use, end-use, and individual shooter's preferences.

The present invention aims in particular to improve the ease of use and ergonomics of the firearm, allowing both functions to be operated through a single gesture.

SUMMARY

In light of the above, the problem underlying the present invention is to devise a break-barrel firearm that can be secured and controlled to open and close effectively and functionally.

Within the scope of this problem, an object of the present invention is to realize a break-barrel firearm that offers greater convenience of use compared to the firearms of the state of the art.

Another object of the present invention is to study a break-barrel firearm that has a reduced number of operating interfaces to control the different operations to be carried out, for example when restoring ammunitions.

In accordance with a first aspect thereof, the invention therefore concerns a firearm comprising at least:

a. a frame; and b. a barrel group comprising at least one barrel, wherein the barrel group is mounted in a tilting manner with respect to the frame.

The frame houses at least one trigger device configured to trigger the firing of an ammunition, a safety device configured to act on the trigger device so as to selectively disengage it, and a closing device configured to act between the frame and the barrel group so as to selectively prevent the barrel group from tilting with respect to the frame.

According to the present invention, the firearm comprises an actuation element configured to selectively activate the safety device and the closing device.

The Applicant has devised a special actuation element capable of selectively activating the safety device and the closing device. Advantageously, this allows to offer the user a single interface through which to control the various operations to be performed with the firearm, other than firing, such as securing it, opening it to restore ammunitions and so on. Thanks to the use of a single interface, the user is therefore able to handle the firearm in a more comfortable and ergonomic way.

The present invention may have at least one of the preferred following features; the latter may in particular be combined with one another as desired in order to meet specific application needs.

In a variant of the invention, the actuation element is made as a slider arranged externally to the frame and is movable in translation.

Preferably, the actuation element is arranged at a rear portion of the frame.

Further, the actuation element is preferably movable alternately in a direction towards a termination of the rear portion of the frame and in a direction towards a front portion of the frame.

In a variant of the invention, the trigger device comprises a group of trigger elements connected in chain and configured to act on at least one firing pin, wherein the actuation element interferes with the group of trigger elements so as to make it inoperative both when the actuation element is translated in the direction towards the rear portion, and when the actuation element is translated in the direction towards the front portion of the frame.

In a variant of the invention, the actuation element cooperates with a safety element, preferably "L"-shaped, housed internally to the frame in a tilting manner between a rest position in which the safety element does not interfere with the group of trigger elements and a safety position in which the safety element interferes with the group of trigger elements so as to make it inoperative. The safety element is brought into the safety position by a translation of the actuation element in the direction towards the front portion of the frame.

Advantageously, the actuation element is thus able to secure the trigger device by disengaging it, whether it is moved towards the rear portion of the frame, or whether it is moved towards the front portion of the frame, in the latter case in order to actuate the closing device, bringing it into the release configuration.

In a variant of the invention, the closing device comprises:

c. at least one pair of clamping elements with longitudinal development independent of each other, the clamping elements being slidably housed within the frame, each along its own longitudinal development axis; and d. at least one pair of buffers each coupled to a respective clamping element so as to exert an axial thrust force on the respective clamping element substantially in parallel to and/or substantially along the respective longitudinal development axis; and e. a manoeuvring group configured to impart to each clamping element of the pair of clamping elements a force in opposition to a force exerted by a buffer on the respective clamping element, the manoeuvring group being actuated by the actuation element.

Advantageously, by making the closing device with a pair of mutually independent clamping elements, each associated with a respective buffer capable of exerting an axial thrust force in parallel to and/or substantially along the development axis of the respective closing element, it is possible to considerably reduce the wear of both clamping element itself and the seat in which it is housed.

Preferably, the manoeuvring group comprises a lever mechanism inside the frame that engages the pair of clamping elements, and wherein the actuation element is coupled to the lever mechanism, so that an advancement of the actuation element towards a front portion of the frame causes a translation of the pair of clamping elements in opposition to the force exerted by the respective buffers.

Advantageously, the lever mechanism acts uniformly on both clamping elements, applying an opposing substantially coaxial to the thrust force of the buffers. In this way, no moments are created on the clamping element that could lead to wear or degradation of the seat thereof.

Preferably, the lever mechanism cooperates with a releasable locking rod housed in the frame movably along its own rod axis and configured to retain the lever mechanism in an engagement position corresponding to a position of maximum translation of the pair of clamping elements in opposition to the force exerted by the respective buffers.

Advantageously, the locking rod reliably ensures that the lever mechanism maintains the engagement position at which the pair of clamping elements is maintained in a maximum backward configuration from the housing seat of the barrel group.

Preferably, the releasable locking rod cooperates with a release rod housed in the frame movably along its own rod axis, between a configuration of greater protrusion from the frame at a housing seat of the barrel group located at a front portion of the frame and a configuration of lesser or no protrusion from the housing seat of the barrel group, wherein in the configuration of greater protrusion the release rod does not cooperate with the releasable locking rod and in the configuration of lesser or no protrusion, the release rod cooperates with the releasable locking rod to disengage it from the lever mechanism.

Advantageously, thanks to the protrusion condition of the release rod from the housing seat, said release rod is actuated by the barrel group itself, when the latter is returned to the closed configuration in which it engages said seat. In this way, therefore, by returning the barrel group to the closed position, there is an automatic release of the lever mechanism from the locking rod.

In a variant of the invention, each buffer of the pair of buffers is mounted on a respective side of a rear portion of the frame.

Advantageously, the specific construction of the support of the buffer and its particular positioning facilitate mounting the buffer on the frame, thus making it possible to easily implement an automation of the production operations of the firearm.

In a variant of the invention, the trigger device comprises a hammer configured to switch from a cocked hammer condition to a released hammer condition following an actuation of the trigger device. There is also a recocking group configured to act on the trigger device so as to switch the hammer from the released hammer condition to the cocked hammer condition, the recocking group comprising a recocking forend housed in a base wall of a front portion of the frame in a sliding manner between a rear portion and the front portion of the frame and an insert interposed between the recocking forend and the barrel group, the insert comprising a slide-shaped portion engaging the barrel group.

Advantageously, the engagement of the barrel group with a portion of the slide-shaped insert reduces the wear that usually characterizes the forend of the recocking group.

BRIEF DESCRIPTION OF THE DRAWINGS

Further characteristics and advantages of the present invention will become clearer from the following detailed description of some preferred embodiments thereof, made with reference to the appended drawings.

The different features in the individual configurations can be combined with each other as desired according to the following description, if the advantages resulting specifically from a particular combination are to be availed of.

In Such Drawings:

FIG. 1 is a perspective view of a first preferred embodiment of a firearm according to the present invention;

FIG. 2 is a partial perspective view of a preferred embodiment of a firearm according to the present invention in which only the frame is shown with a locking group mounted, in closed configuration with engaged safety;

FIG. 3 is a perspective view of the parts of the firearm shown in FIG. 2, in the closed configuration without engaged safety;

FIG. 4 is a perspective sectional view along a first vertical plane of the parts of the firearm shown in FIG. 3;

Figure 2:
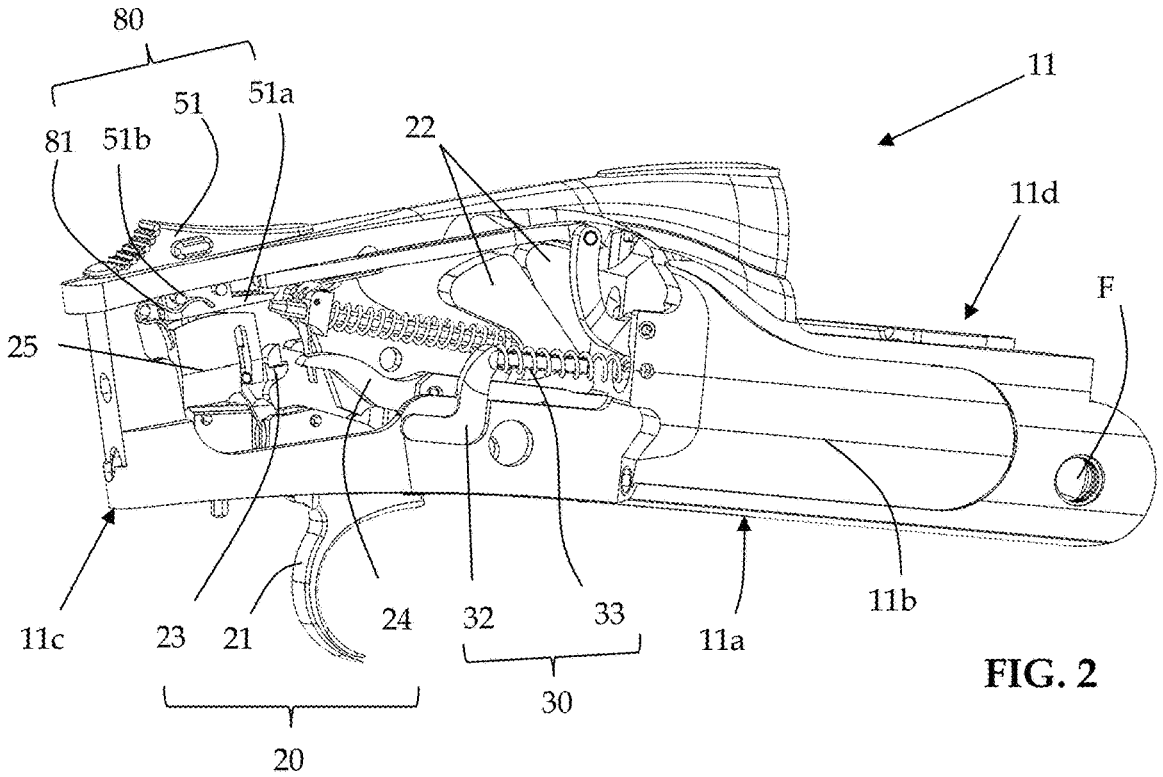
Figure 3:
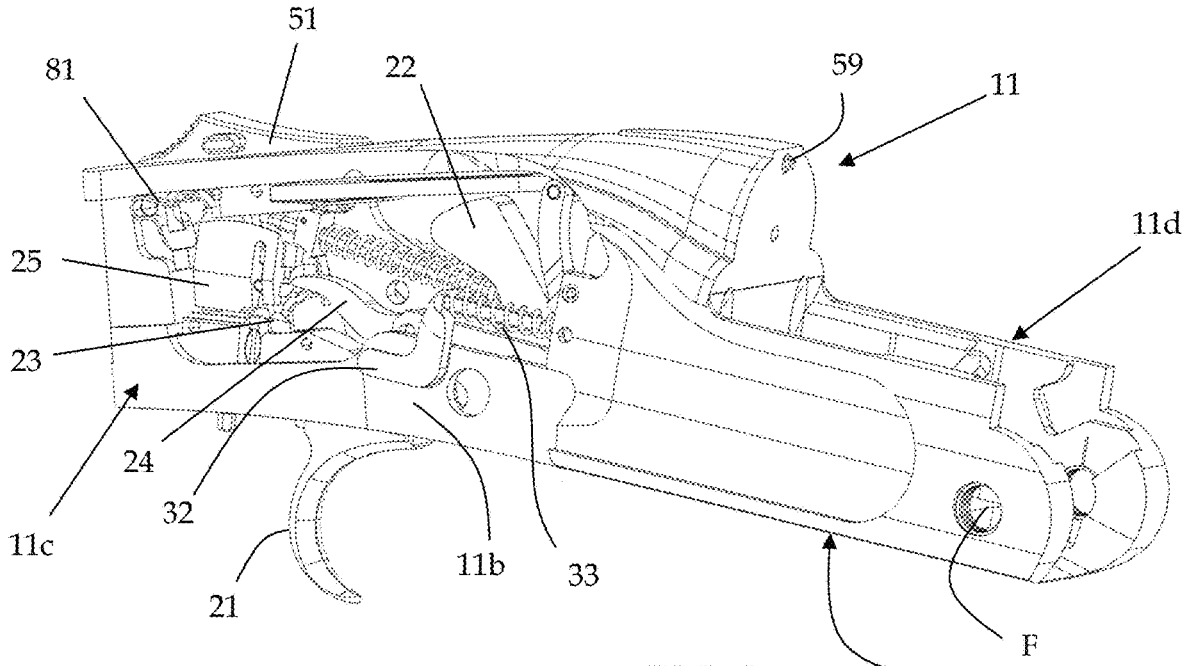
Figure 5:
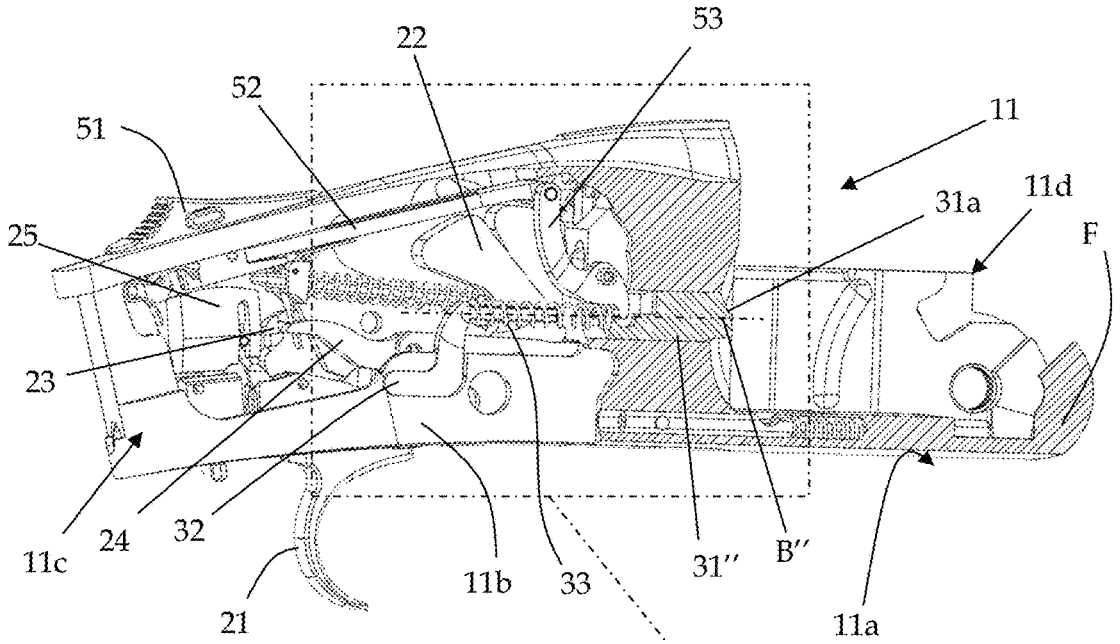
Figure 5A:
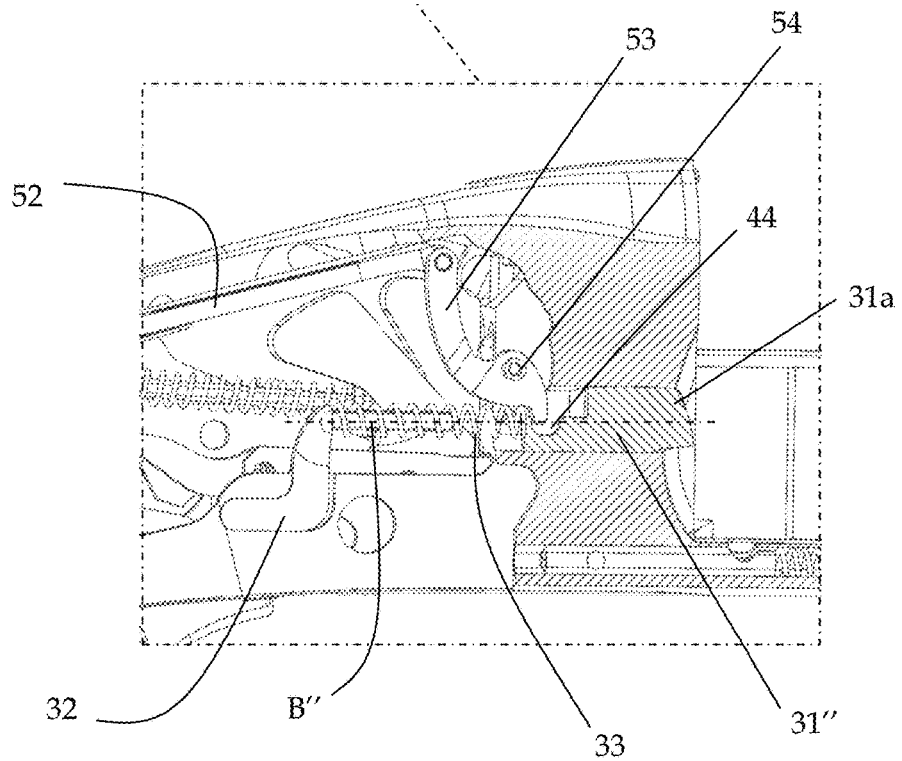
Figure 6A:
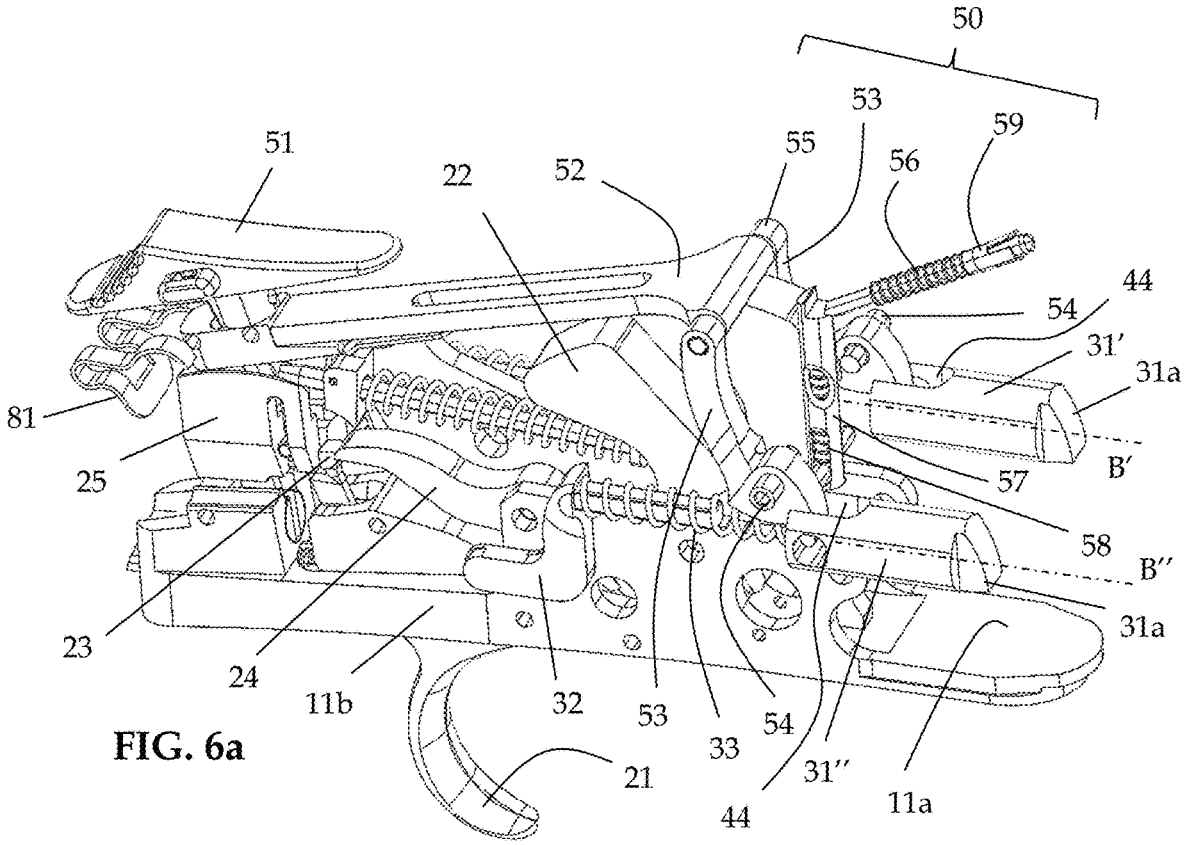
Figure 6B:
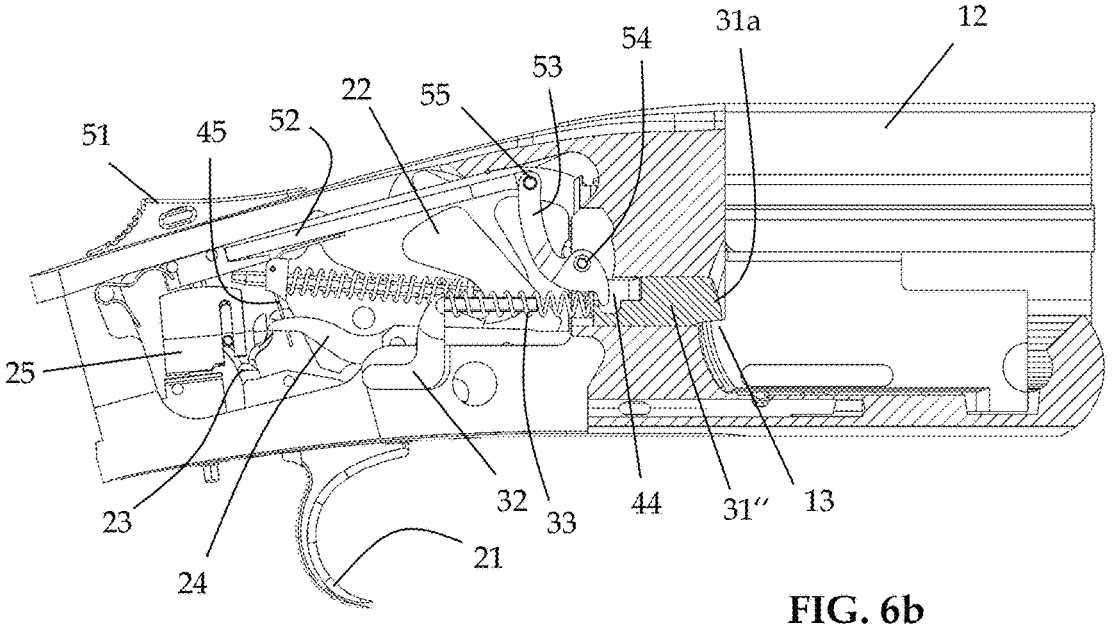
Figure 7A:
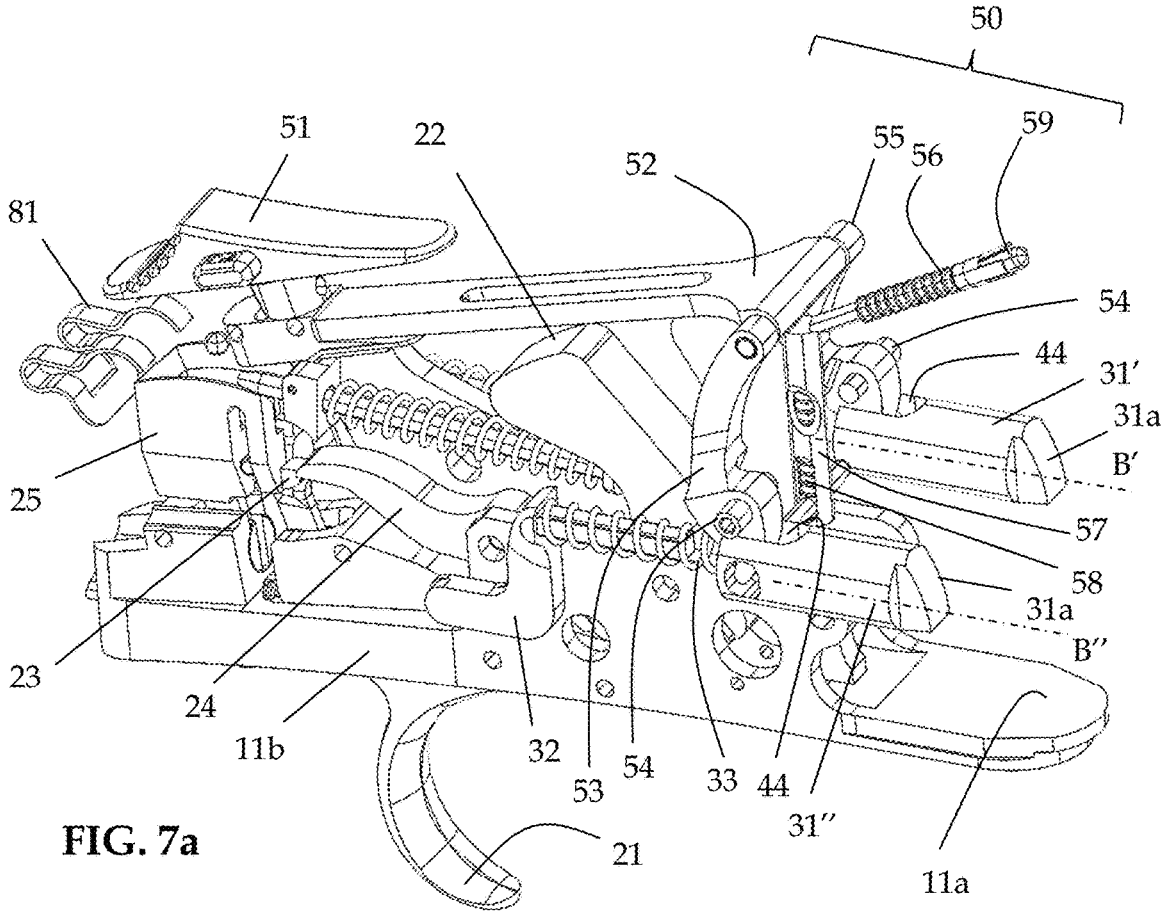
Figure 7B:
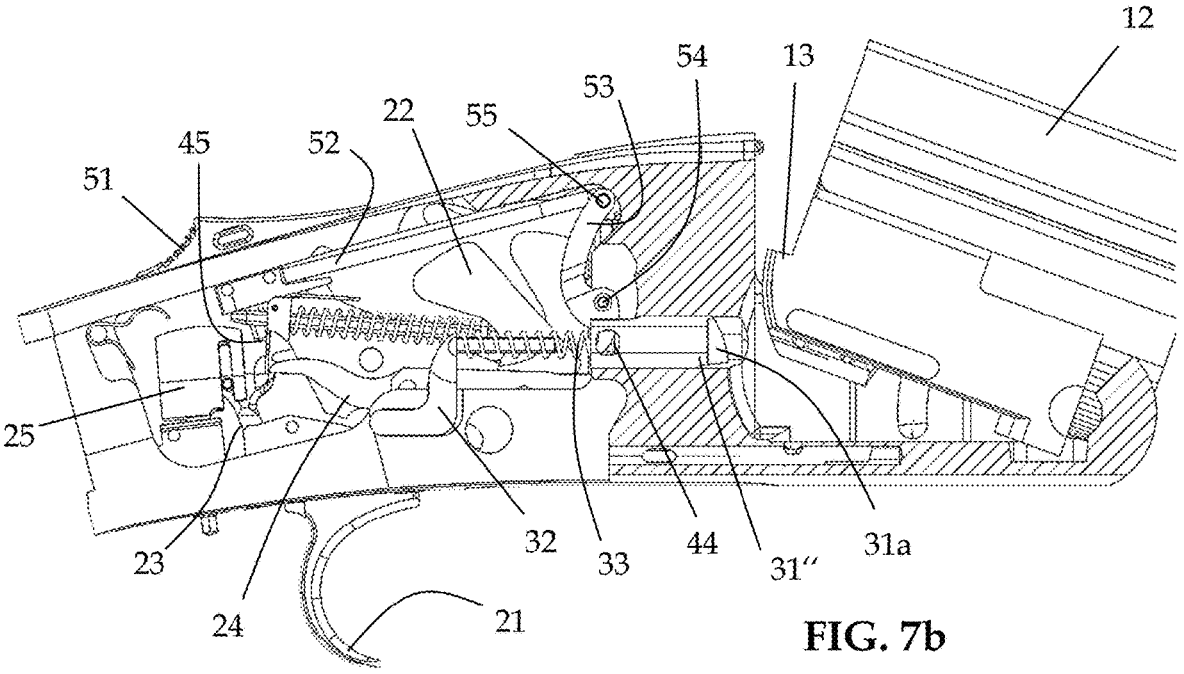
Figure 8:
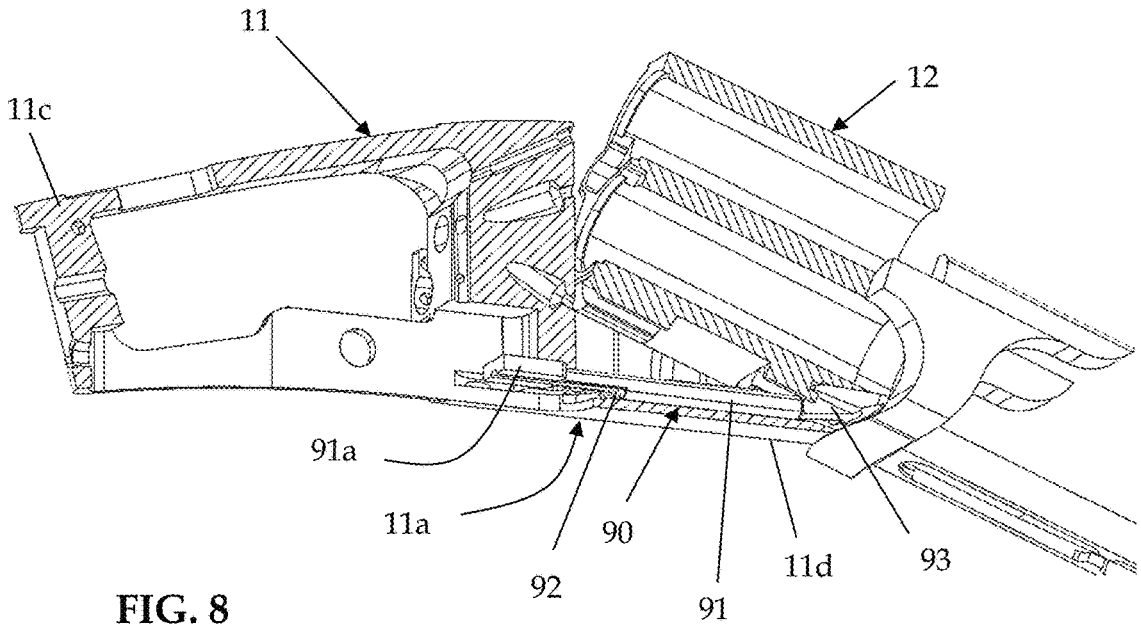
Figure 9:
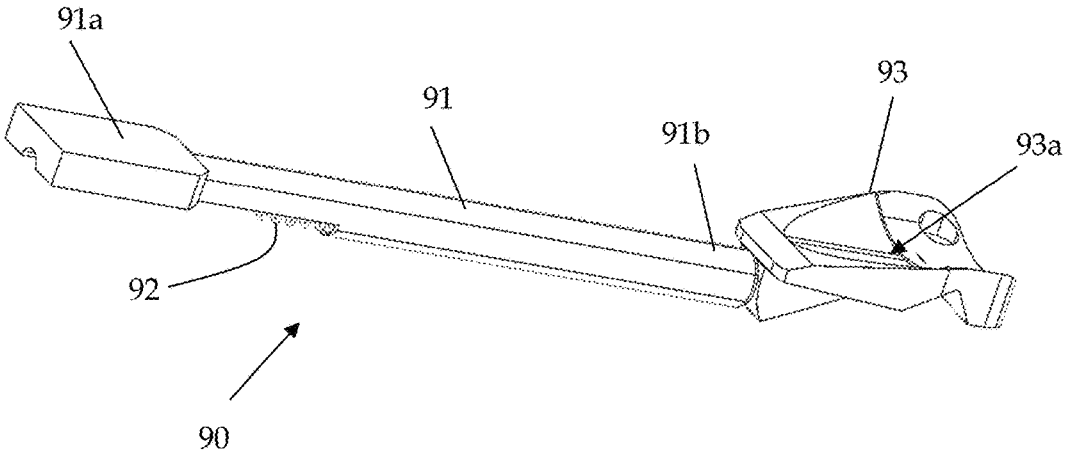

FIGS. 5 and 5*a* are, respectively, a perspective sectional view along a second vertical plane of the parts of the firearm shown in FIG. 3, and an enlarged detail thereof;

FIGS. 6*a* and 6*b* are, respectively, a perspective view with some parts removed for clarity of illustration, and a sectioned view in side elevation of the frame of the firearm of FIG. 2, in closed configuration without engaged safety;

FIGS. 7*a* and 7*b* are, respectively, a perspective view with some parts removed for clarity of illustration, and a sectioned view in side elevation of the frame of the firearm of FIG. 2, in open configuration;

FIG. 8 is a perspective sectional view of some components of the firearm in open configuration with the recocking group shown; and FIG. 9 is a perspective view of the recocking group of FIG. 8.

DETAILED DESCRIPTION OF THE INVENTION

For the illustration of the drawings, use is made in the following description of identical numerals or symbols to indicate construction elements with the same function. Moreover, for clarity of illustration, certain references may not be repeated in all drawings.

While the invention is susceptible to various modifications and alternative constructions, certain preferred embodiments are shown in the drawings and are described hereinbelow in detail. It must in any case be understood that there is no intention to limit the invention to the specific embodiment illustrated, but, on the contrary, the invention intends covering all the modifications, alternative and equivalent constructions that fall within the scope of the invention as defined in the claims.

The use of "for example," "etc.," "or" indicates non-exclusive alternatives without limitation unless otherwise indicated. The use of "comprises" and "includes" means "comprises or includes, but not limited to," unless otherwise indicated.

In addition, measurements, values, shapes and geometric references (such as perpendicularity and parallelism), when associated with words such as "about" or other similar terms such as "almost" or "substantially", are to be understood as "unless there are measurement errors" or "unless there are inaccuracies due to production and/or manufacturing errors" and, above all, "unless there is a slight deviation from the value, measurement, shape or geometric reference to which it is associated".

Moreover, the use of terms such as "first," "second," "main" and "secondary" does not necessarily identify an order, a relationship priority or relative position; these terms can simply be used to distinguish between similar components.

Last but not least, relative positioning terms such as "upper," "lower," "front," "rear," or "side" generally refer to the normal configuration of use, in this specific case to the grip configuration of the firearm in order to proceed with shooting.

Figure 1:
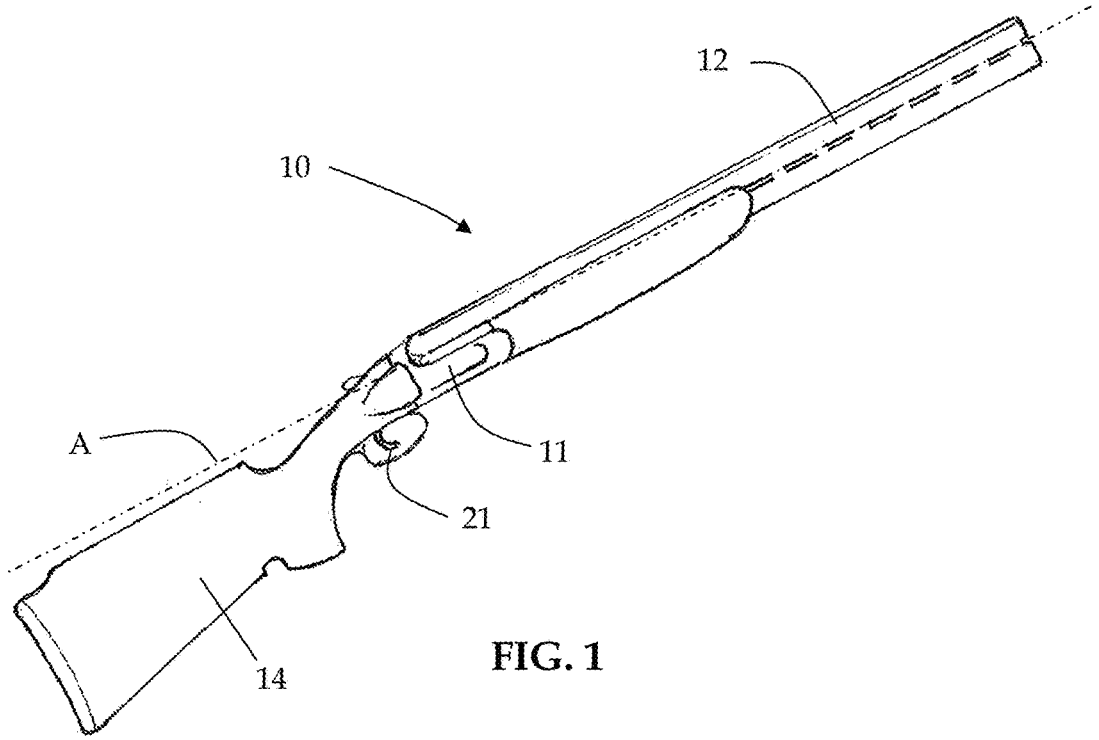

With reference to FIG. 1, a preferred embodiment of a firearm according to the present invention is illustrated, overall indicated as firearm 10.

The firearm 10, hereinafter for brevity's sake also "weapon 10", comprises a frame 11 to which a stock 14 and a barrel group 12, illustrated in FIG. 1, are mounted. The stock 14 is mounted integrally with the frame 11, while the barrel group 12 is mounted on the frame 11 in a tilting manner between a closed position in which the barrel group 12 is partially housed in a seat defined at a front portion 11*d* of the frame 11 and extends in parallel to a base wall 11*a* of the frame 11, and an open position in which the barrel group 12 is rotated with respect to the base of the frame 11 (see FIG. 2). In other words, the frame 11 identifies a fulcrum F around which the barrel group 12 is hinged.

The barrel group 12 comprises a structure delimiting at least one barrel extending along a longitudinal development axis A of the barrel. By way of example, but not limitation, in the embodiment illustrated in FIG. 1, the barrel group 12 comprises two overlapping barrels extending along the longitudinal development axis A. However, in alternative embodiments, the barrel group may comprise a single barrel or two side-by-side barrels.

With reference to FIGS. 2-5*b*, the frame 11 houses therein a trigger device 20 configured to trigger the firing of an ammunition, a safety device 80 configured to act on the trigger device 20 so as to disengage it, thereby preventing a firing of an ammunition regardless of the condition of the trigger device 20, and a closing device 30 configured to selectively prevent the barrel group 12 from tilting with respect to the frame 11.

By way of example, the trigger device 20 comprises at least one trigger 21 movably mounted (for example rotatable or translatable) on the frame 11 to actuate a group of in chain-connected trigger elements and configured to act on at least one firing pin (not illustrated). In the illustrated embodiment, the group of trigger elements comprises a release 23 stabilized by a mass 25 and configured to move at least one sear 24, which in turn actuates a respective hammer 22 to act on the respective firing pin. The trigger device also comprises a recocking foot (not illustrated) configured to act on the hammer 22 to bring it from a released hammer condition, following the firing of an ammunition, into a cocked hammer condition, following the closing of the firearm 10. A recocking group 90 acts on the recocking foot, which is described in detail below with reference to FIGS. 8 and 9.

The safety device 80 comprises an actuation element made as a slider 51 (hereinafter also for brevity 'slider 51') arranged externally to the frame 11 at a rear portion 11*c* of the frame and movable in translation in the direction towards a termination of the rear portion 11*c* of the frame.

When the slider 51 is made to translate, starting from a neutral position, illustrated in FIGS. 3-6*b*, towards the termination of the rear portion 11*c* of the frame (position illustrated in FIG. 2), it indirectly cooperates with the release 23 of the trigger device 20 so as to decouple it from the sear 24, thus disengaging the trigger device 20.

In detail, in the illustrated embodiment, the slider 51 cooperates with the mass 25 that stabilizes the release 23 so as to drag it at least partially along with it towards the termination of the rear portion 11*c* of the frame when it is translated in this direction. This movement of the mass 25 also causes a backward movement of the release 23 which therefore disengages from the sear 24, as shown in FIG. 2, being no longer able to activate it following a movement of the trigger 21.

There is also a retention element 81, for example of the elastic type, arranged and configured to retain the slider 51 in the backward position located in proximity to the termination of the rear portion 11*c* of the frame. To this end, the slider 51 comprises a portion 51*a* that extends internally to the frame 11 and comprises at least one protruding pin 51*b* configured to releasably engage the retention element 81.

The closing device 30 is configured to act between the frame 11 and the barrel group 12, when the firearm 10 is in the closed configuration; in particular, the closing device 30 is manoeuvrable between a locking position (illustrated in FIGS. 6*a* and 6*b*), in which it engages the barrel group 12 to prevent the tilting with respect to the frame 11, and a release position (illustrated in FIGS. 7*a* and 7*b*), in which the closing device 30 is disengaged from the barrel group 12 and the barrel group 12 is therefore free to rotate with respect to the frame 11.

In the illustrated embodiment, the closing device 30 comprises at least one pair of clamping elements 31', 31" with longitudinal development independent and separate from each other, visible in detail in FIGS. 6*a* and 7*a*.

Figure 4:
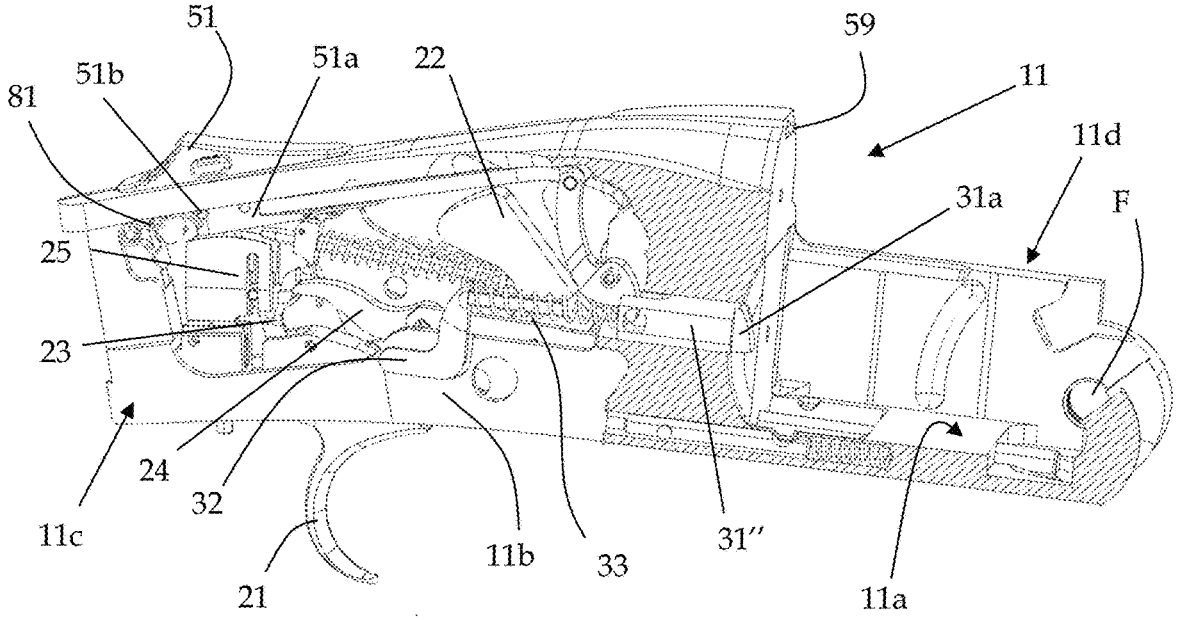

As shown in FIGS. 4 and 5, the clamping elements 31', 31" are at least partially received internally to the frame 11. The clamping elements 31', 31" develop along a respective development axis B', B" of the clamping elements and are slidably received within the frame 11, along their own longitudinal development axis B', B".

In particular, the clamping elements 31', 31" are housed inside the frame 11 in a sliding manner between a position in which a first end part 31*a* of the clamping element 31', 31", preferably tip-shaped, protrudes towards a housing seat of the barrel group 12 located at the front portion 11*d* of the frame (shown in FIGS. 3-6*b*) and a position in which the first end part is retracted and substantially does not protrude into the housing seat of the barrel group 12 (shown in FIGS. 7*a* and 7*b*). Consequently, when the barrel group 12 is in the closed position, as illustrated in detail in FIG. 6*b*, the clamping elements 31', 31" engage, each with its own first end part 31*a*, a respective hook 13 made on the barrel group 12. Otherwise, when the closing device 30 is actuated to open, the clamping elements 31', 31" do not engage the respective hooks 13 and the barrel group 12 is free to tilt.

The closing device 30 also comprises a pair of buffers 32, 33 each mounted on a respective side 11*b* of the rear portion 11*c* of the frame 11. Each buffer 32, 33 comprises a support 32 carrying a first elastic element 33, interposed between the support 32 and a respective clamping element 31', 31" and exerting an axial thrust force on the respective clamping element 31', 31" substantially in parallel to and/or substantially along the longitudinal development axis B', B" thereof, so that, in the absence of applied forces, the clamping elements 31', 31" protrude from the frame 11 with their first end part 31*a*, towards the housing seat of the barrel group 12.

The closing device 30 further comprises a manoeuvring group 50 configured to impart to each clamping element 31', 31" of the pair of clamping elements a force in opposition to a force exerted on each clamping element 31', 31" by the respective buffer 32, 33.

In the illustrated embodiment, the manoeuvring group 50 advantageously coincides with the actuation element 51 of the safety device 80 made as a slider.

The slider 51 is in fact coupled also to a first lever 52 of a lever mechanism 52, 53 inside the frame 11 so as to advance it towards the front portion 11*d* of the frame 11 up to an engagement position. In the engagement position, the first internal lever 52 engages a releasable locking rod 57 (shown in FIGS. 6*a* and 7*a*) configured to retain the first internal lever 52 in the advanced engagement position.

The first internal lever 52 is in turn hinged to a pair of second internal levers 53 of the lever mechanism 52, 53 at a first end thereof. In particular, the first internal lever 52 is coupled to the second internal levers 53 so that an advancement of the first internal lever 52 towards the engagement position causes a rotation of the second internal levers 53 around a pivot 55 and at the same time around a respective fulcrum pin 54 placed in an intermediate position with respect to the extension of the respective second internal lever 53.

Each of the second internal levers 53 engages, at its own second end, a respective clamping element 31', 31" so that, when the second internal levers 53 are brought into rotation by the advancement of the first internal lever 52, the clamping elements 31', 31" are made to translate in opposition to the force exerted by the respective buffer 32, 33. In this way both clamping elements 31', 31" move backward, retracting the respective first end part 31*a* and decoupling it from the corresponding hook 13.

To this end, the second end of each second internal lever 53 engages a groove 44 located at a second end part of the respective clamping element 31', 31" opposite the first 31*a* so as to drag said clamping element 31', 31" into translation when the second internal lever 53 is brought into rotation.

The releasable locking rod 57 is housed in the frame 11 according to an arrangement substantially orthogonal to the base wall 11*a* of the frame 11 and movably along its own rod axis. The releasable locking rod 57 is normally kept in a position away from the base wall 11*a* by a second elastic element 58. The advancement movement of the first internal lever 52 causes a temporary displacement of the releasable locking rod 57 towards the base wall 11*a*, which takes on again the distanced position once the first internal lever 52 reaches the engagement position. In such a configuration, the locking rod 57 retains the first internal lever 52 in the engagement position. In fact, the first internal lever 52 is in abutment against a step portion obtained at a free end of the locking rod 57.

In order to release the first internal lever 52 from the engagement position, the closing device 50 comprises a release rod 59, housed in the frame 11 according to an oblique arrangement with respect to the base wall 11*a* of the frame 11 and movably along its own rod axis, between a configuration of greater protrusion from the frame 11 at the housing seat of the barrel group 12 (shown in FIGS. 3 and 4) and a configuration of lesser or no protrusion. When brought into the position of lesser or no protrusion, the release rod 59 engages the releasable locking rod 57, displacing it from the distanced position and releasing in this way the first internal lever 52 from this locking rod 57.

The release rod 59 is normally held in the position of greater protrusion by a third elastic element 56 and is brought into the position of lesser or no protrusion by the barrel group 12, when this engages its own housing seat provided at the front portion 11*d* of the frame. In this way, advantageously, by bringing the barrel group 12 into the closed position there is an automatic release of the first internal lever 52 from the locking rod 57. The clamping elements 31', 31" are therefore no longer forced by the set of internal levers 52, 53 in the position with the first end part 31*a* retracting; on the contrary they are returned by the respective first elastic elements 33 into the protruding locking position, with coupling with the hooks 13 of the barrel group 12. This also results in an automatic return of the internal levers 52, 53 into the initial positions.

To ensure that in the open position of the barrel group 12 the trigger device is inoperative, the slider-like actuation element 51 in its lower portion 51*a* extending internally to the frame 11 is shaped so as to cooperate with a safety element 45 arranged internally to the frame 11 (shown in detail in FIGS. 6*b* and 7*b*). The safety element 45 is made as a sheet metal and has an L-shaped profile. The safety element 45 is arranged in the frame in an oscillatable manner between a rest position in which the safety element 45 does not interfere with the group of trigger elements (see FIG. 6*b*) and a safety position in which it interferes with the group of trigger elements so as to make it inoperative (see FIG. 7*b*). Advantageously, the slider-like actuation element 51 and the safety element 45 cooperate so that an advancement of the slider element 51 in the direction towards the front portion 11*d* of the frame causes an oscillation of the safety element 45 such as to bring it into the safety position.

FIG. 8 shows the frame 11 and part of the barrel group 12 in which, for clarity of illustration, only the recocking group 90 is illustrated. The recocking group 90 comprises a recocking forend 91 housed in the base wall 10*a* of the front portion 11*d* of the frame in a sliding manner between the rear portion 11*c* and the front portion 11*d* of the frame.

A first end 91*a* of the recocking forend 91 is configured to cooperate with the recocking foot of the trigger device 20 so that it brings the hammer 22 into the cocked hammer condition. In particular, the recocking forend 91 cooperates with the recocking foot when it is moved towards the frame bottom 11*c*, following a rotation of the barrel group 12 to return it to the closed configuration.

The recocking group 90 further comprises a fourth elastic element 92 configured to maintain the recocking forend 91 in a disengagement position from the recocking foot of the trigger group 20.

The recocking group 90 finally comprises an insert 93, illustrated in detail in FIG. 9, interposed between the recocking forend 91 and the barrel group 12, in particular arranged at a second end 91*b* of the recocking forend 91 opposite the first one 91*a*. The insert 93 is configured to transfer to the recocking forend 91 a thrust in the direction of the barrel bottom 11*c* when the barrel group 12 passes from the open configuration to the closed configuration. The insert 93 engages the barrel group 12 with a slide-shaped portion 93*a* thereof, facilitating the closing operations of the firearm 10 and thus reducing the wear that usually characterizes the forend 91 of the recocking group 90.

What is claimed is:

1. A firearm comprising at least:

a frame; and a barrel group comprising at least one barrel, the barrel group being mounted in a tilting manner with respect to the frame, wherein the frame houses at least one trigger device configured to trigger the firing of an ammunition, a safety device configured to act on the trigger device so as to selectively disengage it, and a closing device configured to act between the frame and the barrel group so as to selectively prevent the barrel group from tilting with respect to the frame, wherein the closing device comprises a slider configured for translational motion to selectively activate the safety device and the closing device.

2. The firearm according to claim 1, wherein the slider is arranged externally to the frame.

3. The firearm according to claim 1, wherein the slider is arranged at a rear portion of the frame and/or movable alternately in a direction towards a termination of the rear portion of the frame and in a direction towards a front portion of the frame.

4. The firearm according to claim 3, wherein the trigger device comprises a group of trigger elements connected in chain and configured to act on at least one firing pin, wherein the slider interferes with the group of trigger elements so as to make it inoperative both when the actuation element is translated in the direction of the rear portion, and when the actuation element is translated in the direction towards the front portion of the frame.

5. The firearm according to claim 4, wherein the slider cooperates with a safety element housed internally to the frame in a tilting manner between a rest position in which the safety element does not interfere with the group of trigger elements and a safety position in which the safety element interferes with the group of trigger elements so as to make it inoperative, the safety element being brought into the safety position by a translation of the slider in the direction towards the front portion of the frame.

6. The firearm according to claim 5, wherein the safety element is "L" shaped.

7. The firearm according to claim 4, wherein the group of trigger elements comprises a release stabilized by a mass and configured to move at least one sear, which in turn actuates a respective hammer to act on a respective firing pin of the on at least one firing pin.

8. The firearm according to claim 1, wherein the closing device comprises:

at least one pair of clamping elements with longitudinal development and independent of each other, the clamping elements being slidably housed inside the frame, each along its own longitudinal development axis; and at least one pair of buffers each coupled to a respective clamping element so as to exert an axial thrust force on the respective clamping element substantially in parallel to and/or substantially along the respective longitudinal development axis; and a manoeuvring group configured to impart to each clamping element of the pair of clamping elements a force in opposition to a force exerted by a buffer on the respective clamping element, the manoeuvring group being actuated by the actuation element.

9. The firearm according to claim 8, wherein the manoeuvring group comprises a lever mechanism inside the frame that engages the pair of clamping elements, and wherein the actuation element is coupled to the lever mechanism, so that an advancement of the actuation element towards a front portion of the frame causes a translation of the pair of clamping elements in opposition to the force exerted by the respective buffers.

10. The firearm according to claim 9, wherein the lever mechanism cooperates with a releasable locking rod housed in the frame movably along its own rod axis and configured to retain the lever mechanism in an engagement position corresponding to a position of maximum translation of the pair of clamping elements in opposition to the force exerted by the respective buffers.

11. The firearm according to claim 10, wherein the releasable locking rod cooperates with a release rod housed in the frame movably along its own rod axis, between a configuration of greater protrusion from the frame at a housing seat of the barrel group located at a front portion of the frame and a configuration of lesser or no protrusion from the housing seat of the barrel group, wherein in the configuration of greater protrusion the release rod does not cooperate with the releasable locking rod and in the configuration of lesser or no protrusion the release rod cooperates with the releasable locking rod to decouple it from the lever mechanism.

12. The firearm according to claim 8, wherein each buffer of the pair of buffers is mounted on a respective side of a rear portion of the frame.

13. The firearm according to claim 1, wherein the trigger device comprises a hammer configured to switch from a cocked hammer condition to a released hammer condition following an actuation of the trigger device, and wherein it is comprised a recocking group configured to act on the trigger device so as to switch the hammer from the released hammer condition to the cocked hammer condition, the recocking group comprising a recocking forend housed in a base wall of a front portion of the frame in a sliding manner between a rear portion and the front portion of the frame and an insert interposed between the recocking forend and the barrel group, the insert comprising a slide-shaped portion engaging the barrel group.

14. The firearm according to claim 13, wherein the insert is configured to transfer a thrust to the recocking forend in the direction of a rear portion of the frame when the barrel group is tilted from an open configuration to a closed configuration.

15. The firearm according to claim 13, wherein the recocking forend is configured to cooperate with the trigger device to bring the hammer into a cocked hammer condition following a rotation of the barrel group to return it to a closed configuration in which it is partially housed in a seat defined at a front portion of the frame.

16. The firearm according to claim 13, wherein the recocking group further comprises a fourth elastic element configured to maintain the recocking forend disengaged from the trigger group.

17. The firearm according to claim 13, wherein a first end of the recocking forend is configured to cooperate with the trigger device to bring the hammer of the trigger device into the cocked hammer condition.

18. The firearm according to claim 17, wherein the insert is arranged at a second end of the recocking forend opposite the first one.

* * * * *